United States Patent [19]

Hetke et al.

[11] 4,003,424

[45] Jan. 18, 1977

[54] METHOD OF MAKING DUCTILE IRON TREATING AGENTS

[75] Inventors: Adolf Hetke, Livonia; Prem P. Mohla, Plymouth; Robert J. Warrick, Ann Arbor, all of Mich.

[73] Assignee: Ford Motor Company, Dearborn, Mich.

[22] Filed: Nov. 10, 1975

[21] Appl. No.: 630,569

[52] U.S. Cl. ..... 164/34; 164/39; 164/69; 164/72; 164/129; 164/122; 164/235

[51] Int. Cl.[2] ..... B22C 9/04; B22D 21/00; B22D 25/02

[58] Field of Search ..... 164/34, 39, 47, 72, 164/129, 57, 58, 59, 69, 122, 235, 246; 249/62, 52

[56] References Cited

UNITED STATES PATENTS

| | | | |
|---|---|---|---|
| 2,146,678 | 2/1939 | Jung | 249/52 X |
| 3,010,852 | 11/1961 | Prange et al. | 164/35 X |
| 3,254,379 | 6/1966 | Poe | 164/34 X |
| 3,374,824 | 3/1968 | Snelling | 249/62 X |
| 3,426,834 | 2/1969 | Jacobs et al. | 164/34 X |
| 3,429,362 | 2/1969 | Tachimoto et al. | 249/52 X |
| 3,658,115 | 4/1972 | Ryntz, Jr. et al. | 164/57 |

FOREIGN PATENTS OR APPLICATIONS

| | | | |
|---|---|---|---|
| 46-17401 | 4/1967 | Japan | 164/57 |
| 1,007,067 | 10/1965 | United Kingdom | 164/34 |
| 1,018,030 | 1/1966 | United Kingdom | |

*Primary Examiner*—Ronald J. Shore
*Attorney, Agent, or Firm*—Joseph W. Malleck; Keith L. Zerschling

[57] ABSTRACT

A method of making a more economical and reliable treating agent for use in late metal treatment when pouring metal castings. The treating agent is defined as an essentially homogeneous solid cast block preferably containing alloying ingredients to nodulize or inoculant ferrous metal. Each block is designed to present a generally uniform reaction surface to molten metal to be treated. This is obtained by casting the block to a shape which snugly fits a prepared basin in the mold gating system over which the molten metal to be treated must flow, or to cast the block in an annular configuration through which the molten metal must flow. The latter block has contoured inner surfaces which maintain a generally constant reactive surface as the block is consumed. These blocks are preferably prepared by simultaneously casting a large number in closely nested relation. Each mold for said blocks receives molten material, out of which the agent is formed, from a common sprue; runners interconnect the mold cavities and sprue, for example, in a simulated "Christmas tree" arrangement. The gating system and mold cavity pattern, for casting the treating agent to a special shape are all comprised of a material that will vaporize upon contact by the molten treating agent, such as polystyrene. The unitary tree structure of foam patterns and gating system is placed in a flask and surrounded by unbonded heat absorbing particles, such as sand or steel shot. Rapid solidification is assured by the selection of heat absorbing particles and by the use of the vaporizable patterns to avoid noticeable segregation in the alloy blocks. The blocks formed for the treating agent are characterized by increased homogeneity, absence of undesirable segregation, absence of internal oxidation, and absence of organic or refractory impurities; the blocks are less costly to make both as to capital requirements and operating expenses.

5 Claims, 4 Drawing Figures

FIG. 3.
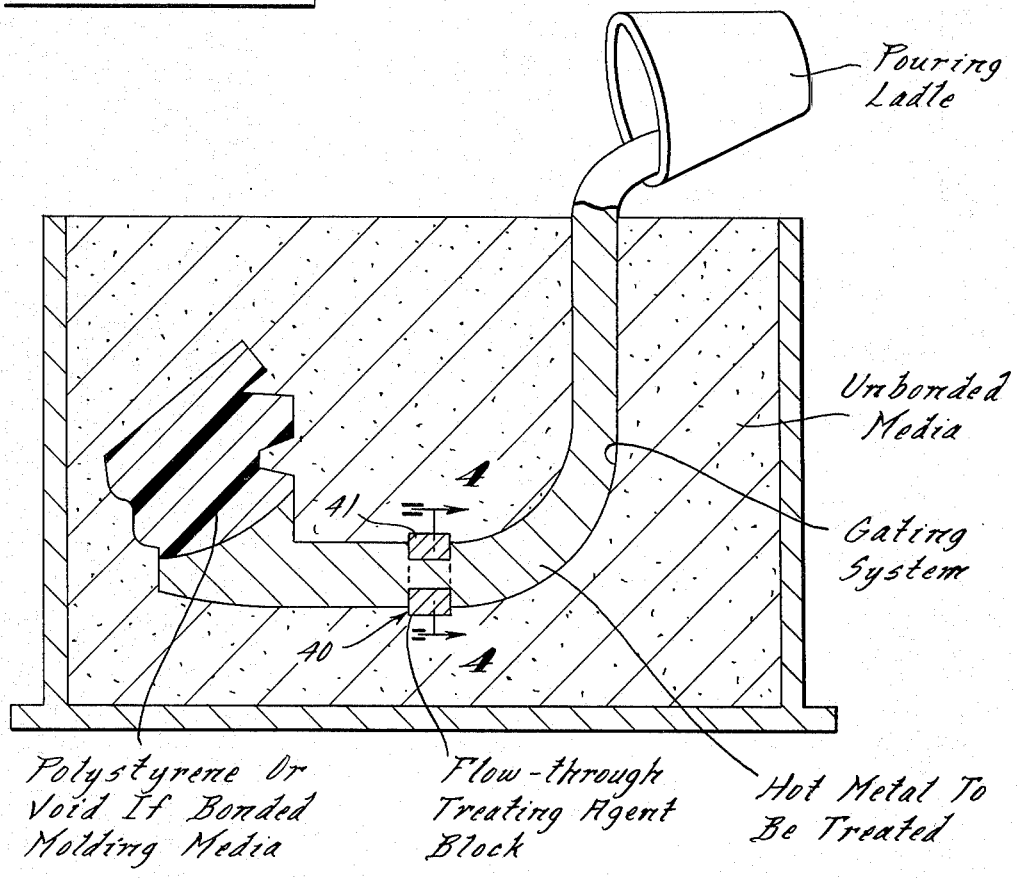
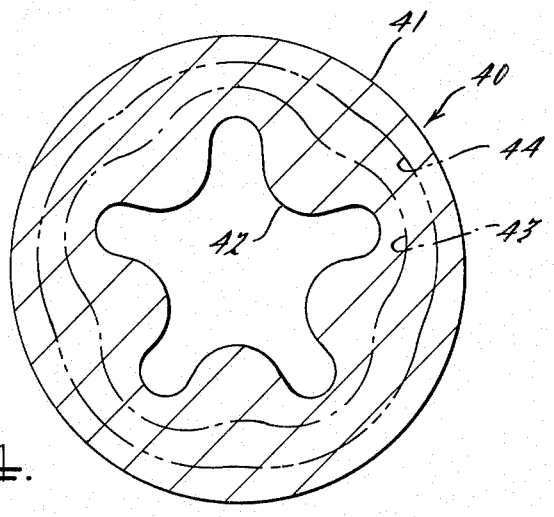
FIG. 4.

METHOD OF MAKING DUCTILE IRON TREATING AGENTS

BACKGROUND OF THE INVENTION

The commercial making of ductile iron was advanced considerably by the discovery that the presence of controlled amounts of magneisum or cerium would facilitate nodulizing the graphite structure and by the discovery that certain inoculants can increase or refine the graphite distribution. The prior art is well aware that the power of the nodulizing agent, when combined with molten iron to effect nodular solidification, will fade the longer the combination is held in the molten state. Thus, it has become desirable to treat the molten iron later in the casting sequence. In certain cases, the treating agent is deposited as a supply of granular material in a special chamber of the gating system of the mold into which the molten metal is to be poured. Thus, the molten metal will encounter the treating agent just before it enters the solidification cavity of the mold. In an extreme application of late treatment, the mold cavity walls may be coated with the nodulizing agent.

One of the most critical problems encountered in late metal treatment is the inability to obtain uniform dissolution of the treating agent within the molten iron. This is due in part to the dynamics of introducing a highly reactive agent to a moving body or stream of molten metal. The problem is also related to the very short time duration for introducing the treating agent in this technique and to the increasing desire to use higher concentrations of magnesium in the treating alloy to facilitate a faster nodulizing effect. Unfortunately, very high non-homogeneous concentrations of magnesium tend to promote (at higher levels) disruptive influence as a result of the reaction during introduction and thus decrease the ability to obtain uniform dissolution.

One particular prior art approach to late metal treatment has been to define an intermediate chamber in the gating system and in which is deposited a predetermined and measured quantity of granular treating agent. The flow of molten metal is diverted to enter this chamber for reaction and thence to the solidification cavity. Most often, such granular material whether loose or briquetted, is affected by the flow of the molten metal therearound causing numerous undesirable effects: (a) some drag-through of the granular material caused by the swift flow of molten metal resulting in the treating agent being trapped within the molding cavity in the unreacted condition, (b) penetration of the molten metal through certain interstices of the granular supply of treating agent, the supply thereby not being gradually and uniformly reacted with the flow of the molten metal and thus causing a non-homogeneous casting, (c) a likelihood that in high volume casting procedures, the proper amount of treating agent is not consistentlly maintained in each of the casting runs, (d) impurities and defects appear in the castings resulting from segregation present in the treating agent when high magnesium contents are employed, (e) contamination of the treating agent during storage by oxidation, (f) difficulty in recycling a treating agent in a pure state if the casting run is cancelled, (g) inability to maintain uniform shape and grain size during handling, (h) less than optimum casting yield.

What is needed is a treating agent which is shaped so that it will consistently provide uniform dissolution into molten metal flowing therepast, can be economically manufactured without the presence of segregation even though containing a high content of nodulizing agent and is unified so that it does not require measurement to be introduced at the time of casting. This need has, in part, been met by the invention of applicants disclosed in co-pending U.S. application Ser. Nos. 584,563 and 584,564, each commonly assigned to the assignee of this invention, the disclosures of which are incorporated herein be reference. These references disclose the unique advantage to be obtained by using a cast-to-shape solid block of treating agent in late metal treatment. What has not been answered by such referenced disclosures is how to make a more reliable homogeneous solid alloy block by techniques which require less capital and operating costs and yet allow some flexibility in the use of molding materials. A more reliable homogeneous solid alloy block would be characterized by the substantial absences of segregation resulting from use of proper chill rates the absence of oxidation interiorly thereof in the mass utilized, the absence of organic or refractory impurities resulting from processing carryover. Lower capital costs would be characterized by higher density casting capability permitted by close nesting of castings in a given mold, avoidance of special mold making and curing equipment, and avoidance of permanent mold destruction and particularly promoting easy recycling of molding materials. Lower operating costs would be characterized by elimination or reduction of casting clean-up, allowance of a faster pour rate from a molten metal reservoir, and use of more economical chill materials to solidify the castings.

SUMMARY OF THE INVENTION

A primary object of this invention is to provide a method of more economically making ductile iron treating agents which facilitate late metal treatment techniques.

Another object is to provide a ductile iron treating agent which is particularly characterized by freedom from segregation while containing a high content of nodulizing material and/or inoculent.

Yet still another object is to provide a treating agent in a unitized form for ease of handling and to eliminate measurement at the time of use.

A specific object is to produce a more reliable homogeneous solid alloy block by employing a vaporizable cavity pattern surrounded by selected, unbonded, particulate, reuseable heat-sink materials. The term "selected" is used herein to mean a choice based on chemistry, particle size, and heat transfer characteristics to render a cooling rate in the casting which is fast enough to avoid undue segregation in any part of the solidified agent and is compatible with desired mechanical properties. The vaporizable cavity pattern facilitates a faster cooling rate by removing some of the superheat of the molten metal as energy to volitize the pattern. The released gaseous products may urge the solidifying molten metal more closely against the chill material with less intervening air gap. The chill materials may be more readily reusable using unbonded sand or steel shot accompanied by a refractory wash coating on the pattern.

Another more particular object of this invention is to provide a method of producing solid blocks each serving as a unitized shot of treating material useful for both inoculation and nodulization. The blocks are to be substantially devoid of segregation while preferably containing a high content of magnesium (for nodulization purposes) along with a variety of other alloys selected from the group consisting of: nickel, silicon, iron, calcium and cerium or other known nodulizing and/or inoculating agents. Features pursuant to this particular object comprise the use of a chill material to increase the cooling rate when molding the treating agent; the chill material is preferably bonded or unbonded granular refractory materials, such as sand. When unbonded sand is employed as the chill material, a fugitive polystyrene pattern is used to restrain the sand during casting of the treating agent.

Lastly, an important specific object is to provide a method of making an improved nodulizing agent for inoculating late metal treating techniques which facilitates flow-through solution rate control as opposed to diverting flow to a subjacent intermediate chamber.

BRIEF DESCRIPTION OF THE DRAWINGS

FIG. 3 is a schematic sectional elevational view of a molding arrangement for ferrous casting utilizing a flow through solid block cast by the arrangement of FIGS. 1 and 2; and FIG. 4 is an enlarged sectional view of the block taken along line 4—4 of FIG. 3.

DETAILED DESCRIPTION

Figure 1:
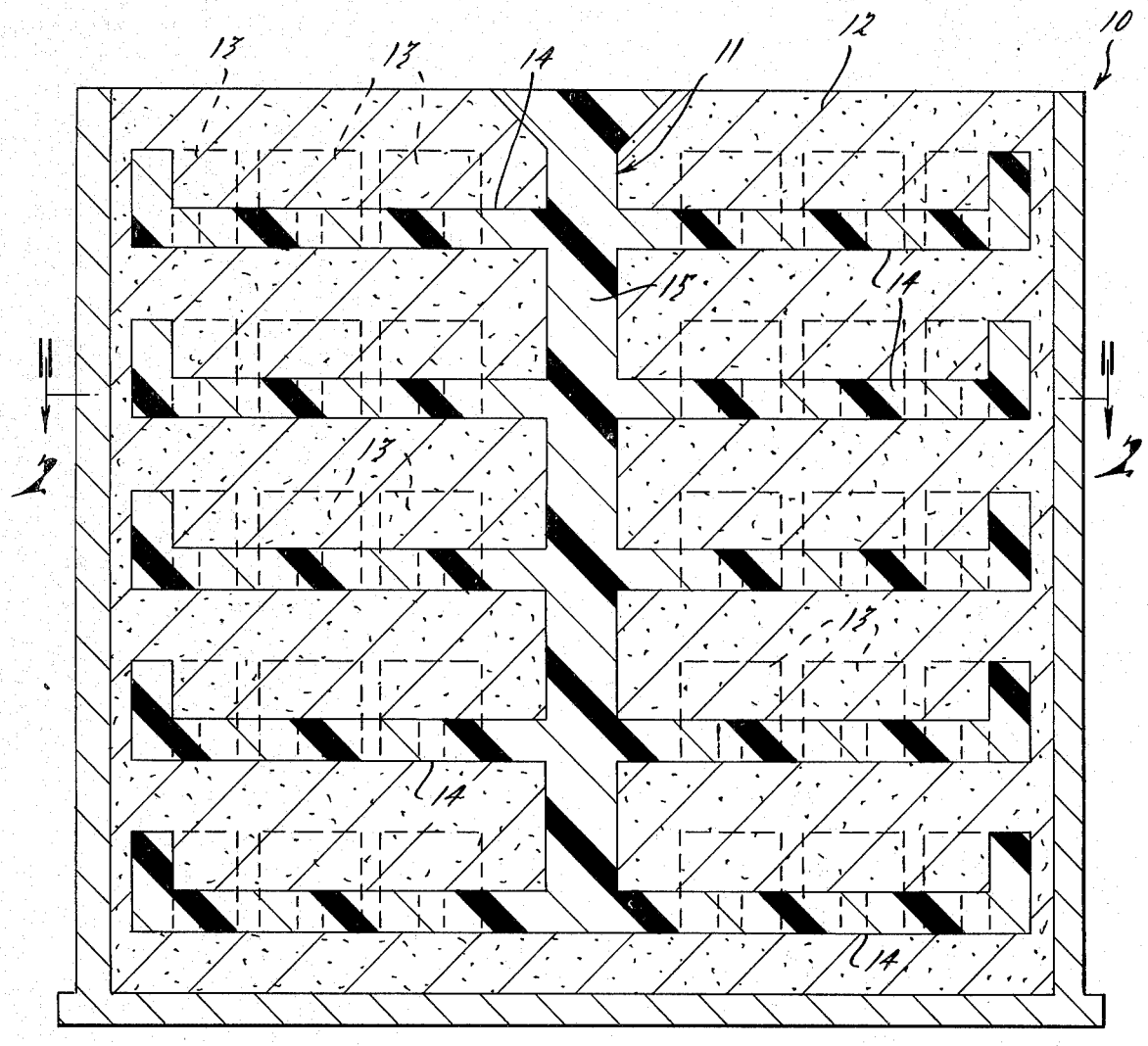
FIG. 1 is a schematic central sectional elevational view of one molding arrangement for casting the treating agent blocks of this invention.

A preferred mode for carrying out the process of this invention is as follows:

1. Provide a supply of heat absorbing particles;
2. Provide a gasifiable pattern to define a molding cavity and to support said heat absorbing particles therearound;
3. Introduce a molten charge of alloying material effective to serve as a treating agent in various types of subsequent casting operations and particularly ductile iron operations;
4. Insure that said alloying materials solidify at a relatively fast cooling rate.

With respect to step (1), the heat absorbing particles may be a mixture of zircon or carbon sand, each of which have a relatively quick chill capability and thereby a high thermal conductivity among refractory mediums. A more preferable medium would be that of unbonded dry silica sand which has a slightly slower chill factor but is more economical. The heat absorbing particles may be selected from a group of materials effective to provide a cooling rate for alloys which avoids noticeable segregation. The process will work with some degree of flexibility in the selection of such materials. Unbonded refractory materials are suitable since they are substantially unaffected by the molten metal and the fugitive pattern permits the refractory particles to be locked together to define a durable cavity wall. Steel shot may also be used and is highly desirable because of enhanced heat absorption to provide an even greater cooling rate. A refractory wash should preferably be applied to the fugitive pattern when sand and/or shot is employed so as to maintain separation between the solidifying metal and heat absorbing material.

The heat absorbing particles are selected firstly on the basis of chemistry that will render a predetermined thermal conductivity to achieve the proper chill rate insuring avoidance of segregation. The particles are selected also on the basis of size to provide a heavy density, close compaction and locking resulting from vibration of the particles.

The heat absorbing particles are preferably introduced to a molding machine having a flask 10 (see FIGS. 1 and 2) after the vaporizable pattern of step (2) has been inserted or suspended in such molding apparatus. The dry unbonded sand 12 is introduced around the pattern 11 and the flask is conveniently vibrated to achieve a highly tight and locked molding medium around such pattern.

It is important that the thickness of the molding medium adjacent to each pattern surface be sufficient to provide a satisfactory heat sink and a fast cooling rate to avoid noticeable segregation in the casting. This is facilitated by limiting the surface/volume ratio of the pattern of at least 1.5.

With respect to step (2), the vaporizable means may particularly comprise polystyrene which has been formed by expansion of and allowed to assume the shape of a mold defining the pattern. The polystyrene pattern may be given a wash on the surface thereof to improve block surface finish and maintain the integrity of the pattern over a greater length of time while being consumed by the molten charge, although this is not necessary to this invention. The polystyrene pattern is preferably formed in a shape and size to define a plurality of individual blocks 13 attached to a common part of the gating system such as by runners 14 to a common down sprue 15. Thus, the down sprue, runner and blocks, are formed in polystyrene.

Two factors must be considered in sizing the blocks; (a) determine the surface-to-volume ratio to insure uniform dissolution within the gating system for a nodular iron process, and (b) determine the thermal conductivity of the heat absorbing particles and adjacent chill elements supporting the particles to provide the desired chill effect.

Figure 2:
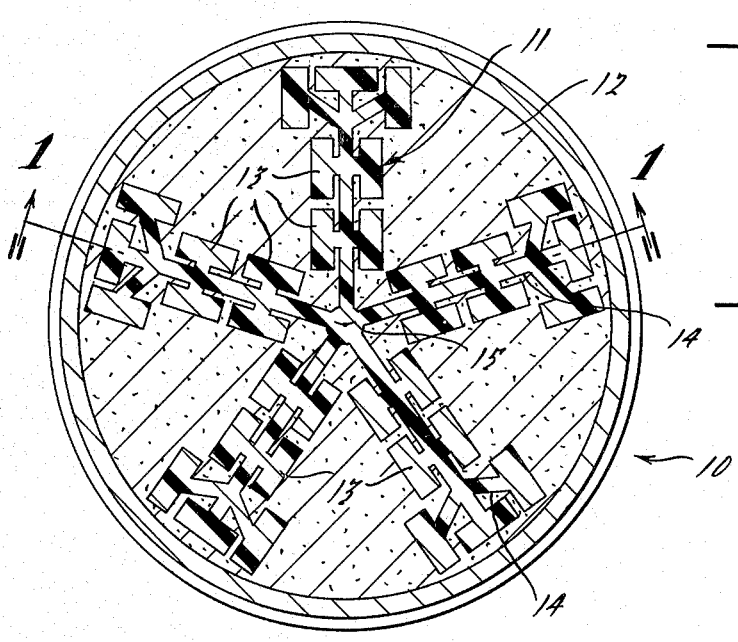
FIG. 2 is a sectional plan view of the arrangement shown in FIG. 1.

As shown in FIGS. 1 and 2 the patterns may be arranged in a Christmas-tree configuration which are "plugged" into a common sprue. The block patterns are connected by runners secondary feeding channels to insure proper flow of molten metal to and through each of the molding cavities. Upon solidification, the feeders, sprues and horizontal runners are detached from the block to define a unitary element for use with a single ductile iron pouring system.

In another arrangement (not shown), the blocks may be formed as a plurality of integral segments in a common sheet; the blocks are manually severable from the solidified sheet. The sheets are arranged in parallel stacked layers, separated by a refractory medium and are connected to a common sprue by horizontal runners similar to FIGS. 1 and 2. Severence from the sheet is facilitated by fracturing along shallow parting lines defined by the mold.

The most important consideration is to provide a sufficient chill factor so that alloying elements may be rapidly cooled to avoid forming segregation at the last to solidify regions.

The cooling rate for solidifying the cast-to-shape blocks is maintained high at low capital and operating costs by the method herein because of several factors: (a) the heat absorbing particles are selected as to maximum heat transmission and heat absorption characteristics while yet being free to be easily recycled, (b) the reduction of any slight air gap that may arise between the solidifying mass and the surrounding chill medium possibly as a result of the presence of gases evolved from vaporizing the pattern, (c) some heat energy of the molten treating agent is used to vaporize the foam patterns and gating system, thus facilitating quicker solidification, and (d) regulating the block pattern to have a volume-to-surface ratio of no greater than 1.5 thereby limiting the degree of convective heat transfer required.

The cast-to-shape block as made herein will be cleaner because of the elimination of noticeable segregation, sand or other heat absorbing particles will not adhere readily to a cast block either interiorly or exteriorly should the block be required to be shifted to a different mold, the elimination of interior oxidation of the sized treating mass, and the elimination of auxiliary cleaning of the castings (such as shot blasting and fin severance).

Capital operating costs are lowered by increasing the density or nesting capability of the number of castings within a single flask, elimination of mold destruction costs (such as mold warpage) since the mold material is recycled, the avoidance of special equipment to make and/or cure expensive molds. Operating costs are substantially lowered by utilizing economical chill materials that can be recycled, allowance for faster pour rates, elimination of clean-up procedures such as flask removal, and care of.

As shown in FIGS. 3 and 4, the treating block 40 may be formed as an annulus or doughnut configuration and is inserted in any part of the conventional gating system of a sand mold, requiring only a snug fit against the walls of the gating system. The flow through block 40 is particularly adapted to the method herein since a vaporizable pattern for the annular block eliminates special sand cores and associated costs, the annular block pattern are merely connected to a foam gating system and the foam assembly is surrounded by vibrated unbonded sand. The annular block has a continuous interior surface 42 which are precontoured, such as in a star-shape, so that uniform erosion of the surface 42 (by reaction with molten metal to be treated) results in a newly exposed surface 43 or 44 each of which have a surface area substantially the same as surface 42. This constant surface area results from an ever-widening diameter for the surface accompanied by a decrease in the star contours.

We claim:

1. A method of making a metal treating agent casting, comprising:

a. providing a fugitive pattern for sand casting comprised entirely of a material effective to be gasified upon contact by the molten treating agent, said pattern being configured to define a block having a constant erodible interface with molten metal to be treated and having a volume/surface ratio no greater than 1.5, b. suspending one or more of said patterns in a molding flask and introducing vibrated selected heat absorbing unbonded particles therearound, said particles being selected from the group consisting of silica sand, zircon sand, chromite sand, carbon sand, and steel shot, and c. introducing a molten treating agent to displace each of said patterns and allowing said treating agent to solidify at rates to avoid noticeable segregation in the resulting casting greater than 0.75% by weight.

2. The method as in claim 1, in which said pattern is provided to define an annulus having a star-shaped interior surface predetermined to uniformly erode leaving substantialy a constant surface area.

3. A method of making a metal treating agent casting comprising:

a. selecting and providing a supply of heat absorbing particles within which is to be defined a molding cavity, said particles being selected to have a thermal conductivity and thermal absorbing capacity equal to or greater than silica sand, b. providing and installing means to occupy substantially said cavity and support said particles thereabout, said means being defined as a plurality of rectangular blocks vaporizable upon contact with a molten charge of treating agent, said blocks having their sides joined in a manner to provide predetermined fracture planes, each block having a predetermined size which provides a surface-to-volume ratio of at least 1.5, either said vaporizable means or heat absorbing particles is provided with a coating at the interface thereof to prevent destruction of the particles at such interface upon contact by molten metal, and c. introducing a molten charge of treating agent to said cavity for totally displacing said pattern and allowing said filled cavity to solidify at a rate to avoid noticeable segregation in the casting, said cooling rate being controlled by the selection of particles and use of a predetermined vaporizable pattern.

4. The method as in claim 3, in which said vaporizable means is configured as a hollow pattern, the hollow portion being filled with said heat absorbing particles.

5. The method as in claim 3, in which the refractory medium is selected from the group consisting of chromite sand, zircon sand, silica sand or metal shot.

* * * * *